United States Patent [19]

Naoi et al.

[11] 4,190,449

[45] Feb. 26, 1980

[54] ANTIADHESIVE PHOTOGRAPHIC MATERIALS AND METHOD OF IMPROVING ANTIADHESIVE PROPERTY OF PHOTOGRAPHIC LIGHT-SENSITIVE MATERIALS

[75] Inventors: Takashi Naoi; Ikutaro Horie, both of Minami-ashigara, Japan

[73] Assignee: Fuji Photo Film Co., Ltd., Minami-ashigari, Japan

[21] Appl. No.: 889,799

[22] Filed: Mar. 24, 1978

[30] Foreign Application Priority Data

Apr. 5, 1977 [JP] Japan ..... 52/39134

[51] Int. Cl.[2] ..... G03C 1/78; G03C 1/96; G03C 1/76; G03C 3/00

[52] U.S. Cl. ..... 430/539; 430/961

[58] Field of Search ..... 96/67, 50 RL, 84 R, 96/87 A; 252/313 S

[56] References Cited

U.S. PATENT DOCUMENTS

| | | | |
|---|---|---|---|
| 3,053,662 | 9/1962 | Mackey et al. | 96/87 A |
| 3,591,379 | 7/1971 | Plakunov | 96/50 R |
| 4,021,245 | 3/1977 | Nagatomo et al. | 96/114.3 |

*Primary Examiner*—Richard C. Schilling

*Attorney, Agent, or Firm*—Sughrue, Rothwell, Mion, Zinn and Macpeak

[57] ABSTRACT

A photographic light-sensitive material comprising a support having thereon at least one silver halide emulsion layer and an outermost layer thereof containing gelatin and colloidal silica prepared by adding potassium hydroxide to an aqueous dispersion of colloidal silica and a method of improving the antiadhesive property of a photographic light-sensitive material which comprises incorporating colloidal silica prepared by adding potassium hydroxide to an aqueous dispersion of colloidal silica into an outermost layer containing gelatin of a photographic light-sensitive material.

5 Claims, No Drawings

ANTIADHESIVE PHOTOGRAPHIC MATERIALS AND METHOD OF IMPROVING ANTIADHESIVE PROPERTY OF PHOTOGRAPHIC LIGHT-SENSITIVE MATERIALS

BACKGROUND OF THE INVENTION

1. Field of the Invention

The present invention relates to photographic light-sensitive materials having improved physical film properties and a method of improving the physical film properties of photographic light-sensitive materials and, particularly, to preventing adhesion of silver halide photographic materials.

2. Description of the Prior Art

A silver halide photographic material generally has a surface layer thereon containing a hydrophilic colloid such as gelatin as a binder. Therefore, the adhesiveness or tackiness of the surface of photographic materials increases under conditions of a high temperature and a high humidity, and the surface of the photographic material easily adheres to other articles when it comes into contact therewith. This phenomenon of adhesion occurs between the photographic material itself or between a photographic material and an article in contact with it during production of the photographic material, at the processing thereof, during projection or during storage thereof, and often various disadvantages occur due to it.

For the purpose of eliminating this problem, a method of reducing the adhesiveness of the surface which comprises incorporating particles having an average particle size of 2 to 5$\mu$, for example, particles of inorganic materials such as silica (silicon dioxide), magnesium oxide, titanium dioxide or calcium carbonate, etc., or particles of organic materials such as polymethyl methacrylate or cellulose acetate propionate, etc., in a surface layer to increase the roughness of the surface, the so-called matting method, is well known to persons skilled in the photographic art.

Hereinafter, the term "antiadhesive property" is used, since the reduction of the adhesiveness between photographic materials themselves or between a photographic material and an article contacting it (making the adhesion difficult) is called "improving the antiadhesive property" in the photographic art.

If the above-described method is carried out to such a degree that a sufficient antiadhesive property is obtained, there are undesirable effects that the transparency of the images formed is deteriorated, the granularity of the images is damaged or slipability is deteriorated with scratches on the photographic material easily occurring.

SUMMARY OF THE INVENTION

Accordingly, an object of this invention is to provide photographic materials with improved antiadhesive properties without the secondary disadvantages described above being present.

Accordingly, the present invention in one embodiment provides a photographic light-sensitive material comprising a support having thereon at least one silver halide emulsion layer and an outermost layer thereof containing gelatin and colloidal silica prepared by adding potassium hydroxide to an aqueous colloid solution of silicic anhydride.

Further, the present invention in another embodiment provides a method of improving the antiadhesive property of a photographic light-sensitive material comprising incorporating an aqueous dispersion of colloidal silica obtained by adding potassium hydroxide to an aqueous colloid solution of silicic anhydride in an outermost layer containing gelatin, e.g., a protective layer and/or a back layer as a "top" layer, of the photographic light-sensitive material.

DETAILED DESCRIPTION OF THE INVENTION

An aqueous colloid solution of silicic anhydride, or an aqueous dispersion of colloidal silica as such is often termed in the art, is a colloid solution comprising water as a main dispersion medium wherein finely divided microparticles of silicic anhydride having an average particle size of about 7 to 120 m$\mu$, preferably 10 to 30 m$\mu$, are dispersed in water, the main component (e.g., about 98% by weight or more) of which is silicon dioxide ($SiO_2$), and it may contain alumina or sodium aluminate as a minor component (e.g., in an amount of about 2% by weight or less). Hereinafter, for simplicity, the term "an aqueous dispersion of colloidal silica" or more simply "colloidal silica" will be used.

The colloidal silica may also contain inorganic salts such as sodium hydroxide, lithium hydroxide or ammonium hydroxide, etc., or organic salts such as a tetramethylene ammonium salt, as an alkali component. Such an alkali component acts as a stabilizing agent for the colloidal silica.

Colloidal silica is described in detail in, for example, *Surface and Colloid Science,* Egon Matijevic Ed., 6, 3–100 (1973), John Wiley & Sons.

Examples of colloidal silica are set forth below.

(1) Colloidal silicas containing sodium hydroxide as a stabilizing agent include Ludox AM ($SiO_2/Na_2O \simeq 231$), Ludox HS-30 ($SiO_2/Na_2O \simeq 94$), Ludox HS-40 ($SiO_2/Na_2O \simeq 93$) and Ludox LS ($SiO_2/Na_2O \simeq 300$), each of which are trade names for colloidal silicas produced by E. I. du Pont de Nemours & Co. (U.S.A.), Nalcoag 1030 ($SiO_2/Na_2O \simeq 75$), Nalcoag 1050 ($SiO_2/Na_2O \simeq 163$), Nalcoag 1060 ($SiO_2/Na_2O \simeq 500$) and Nalcoag ($SiO_2/Na_2O \geqq 340$), each of which are trade names produced by Nalco Chem. Co. (U.S.A.) and Snowtex 20 ($SiO_2/Na_2O \geqq 57$), Snowtex 30 ($SiO_2/Na_2O \geqq 50$), Snowtex C ($SiO_2/Na_2O \geqq 100$) and Snowtex O ($SiO_2/Na_2O \geqq 500$), each of which are trade names produced by Nissan Chemical Industries Ltd. (Tokyo, Japan).

In the description given above, the term $SiO_2/Na_2O$ means the ratio by weight of silicon dioxide ($SiO_2$) to sodium hydroxide wherein sodium hydroxide is calculated as $Na_2O$. The $SiO_2/Na_2O$ ratios given above are those designated by the producers.

(2) A colloidal silica containing ammonia as a stabilizing agent is Ludox AS ($SiO_2/NH_3 \simeq 65$) which is a trade name of the E. I. du Pont de Nemours & Co.

(3) A colloidal silica containing alumina as a stabilizing agent is Nalcoag D-2361 ($SiO_2/Al_2O_3 \simeq 17$) which is a trade name of the Nalco Chem. Co.

Although some of these colloidal silicas have some effect in improving the antiadhesion property if added to an outermost or top layer of a photographic light-sensitive material, the effect of these colloidal silicas is low as compared to the colloidal silica used in the present invention.

Although the colloidal silica used in the present invention contains potassium hydroxide as a stabilizing agent, until now it was not known that when such a colloidal silica was added to the top layer of a photographic light-sensitive material, the antiadhesive property is remarkably improved as compared to the use of colloidal silicas containing other stabilizing agents.

A preferred composition of the colloidal silica used in the present invention is $SiO_2/Na_2O \simeq 350$ to 1,200 and particularly $SiO_2/Na_2O \simeq 500$ to 900, and the content of potassium hydroxide (added either as a solid or in an aqueous solution thereto) used as the stabilizing agent (calculated as $K_2O$) is $SiO_2/K_2O \simeq 50$ to 1,500 and particularly $SiO_2/K_2O \simeq 80$ to 1,000.

A preferred amount of colloidal silica used in the present invention is about 0.05:1 to 1.0:1 and particularly 0.3:1 to 0.5:1 as a ratio of the solid weight based on the dry weight of the gelatin of the top layer.

The term "top layer" or "outermost layer" as used in the description herein of the present invention means a layer containing gelatin as a protective layer, e.g., a protective layer on the silver halide emulsion layer(s), or a back layer, e.g., a layer coated on the support surface opposite to that on which the silver halide emulsion layer(s) is(are) coated. A preferred thickness of the protective layer is about 0.1 to about 3$\mu$ and particularly 1 to 2$\mu$ and that of the back layer is about 1 to about 10$\mu$ and particularly 3 to 6$\mu$. A suitable amount of binder coated per unit area for the protective layer is about 0.1 to about 3 g/m$^2$ and a suitable amount of binder coated per unit area for the backing layer is about 1 to about 10 L g/m$^2$. Of the hydrophilic colloids used as binders in the top or outermost layer in this invention, about 50 to about 100% by weight of the total binder coated per unit area of the top or outermost layer must be gelatin.

Suitable supports for the photographic light-sensitive materials of the present invention include, for example, cellulose nitrate films, cellulose acetate films, cellulose acetate butyrate films, cellulose acetate propionate films, polystyrene films, polyethylene terephthalate films, polycarbonate films and laminates of these films and paper, etc. In more detail, supports such as coated or laminated paper prepared by coating or laminating baryta or polymers of an $\alpha$-olefin having 2 to 10 carbon atoms such as polyethylene, polypropylene or ethylene-butene copolymers, etc., and synthetic resin films as described in Japanese Patent Publication No. 19068/72 wherein the surface is roughened to improve the adhesive property to other high molecular weight materials and to improve the printability thereof.

Where the adhesive strength between the support and the photographic emulsion layer is insufficient, a subbing layer which is adhesive to both the support and the emulsion layer is provided on the support. Further, in order to improve the adhesive property further, the surface of the supports may be subjected to conventional preliminary processings such as a corona treatment, an ultraviolet light treatment or a flame treatment, etc.

The other photographic layers in the photographic light-sensitive materials of the present invention may contain the following binders. For example, proteins such as gelatin, colloidal albumin or casein, etc., cellulose compounds such as carboxydimethyl cellulose or hydroxyethyl cellulose, etc., saccharides such as agar, sodium alginate or starch derivatives, etc., and synthetic hydrophilic colloids such as polyvinyl alcohol, poly-N-vinylpyrrolidone, polyacrylic acid, polyacrylamide, derivatives thereof and the partially hydrolyzed products thereof, etc., can be used as the hydrophilic colloids in these layers. The top layer, in addition to gelatin, may also contain the binders other than gelatin listed above. If desired, a mixture of two or more of these hydrophilic colloids may be used.

Gelatin is the most commonly used as the hydrophilic colloid. The gelatin which can be used can be lime-treated gelatin, acid-treated gelatin and enzyme-treated gelatin. In those layers where gelatin is not essential, a part or all of the gelatin may be replaced not only by synthetic high molecular weight materials but also by the so-called gelatin derivatives, namely, gelatin derivatives prepared by reacting the amino groups, imino groups, hydroxyl groups or carboxyl groups present in the gelatin molecule with compounds having a group reactive with the above-described groups or graft polymers prepared by grafting the molecular chains of high molecular weight materials onto the gelatin. In the layers where gelatin is essential, the above-described gelatin derivatives or graft gelatins can be used in addition to the gelatin in these layers.

The top layer and other hydrophilic colloid layers in the photographic light-sensitive materials of the present invention may be hardened using various kinds of organic or inorganic hardening agents (individually or as a combination thereof).

Preferred hardening agents are described in, for example, C. E. K. Mees and T. H. James, *The Theory of the Photographic Process,* 3rd Edition, Macmillan, New York (1966), U.S. Pat. Nos. 3,316,095, 3,232,764, 3,288,775, 2,732,303, 3,635,718, 3,232,763, 2,732,316, 2,586,168, 3,103,437, 3,017,280, 2,983,611, 2,725,294, 2,725,295, 3,100,704, 3,091,537, 3,321,313, 3,543,292 and 3,125,449 and British Pat. Nos. 994,869 and 1,167,207, etc. Examples of suitable hardening agents include aldehyde compounds such as mucochloric acid, mucobromic acid, mucophenoxychloric acid, mucophenoxybromic acid, formaldehyde, dimethylol urea, trimethylolmelamine, glyoxal, monomethyl glyoxal, 2,3-dihydroxy-1,4-dioxane, 2,3-dihydroxy-5-methyl-1,4-dioxane, succinaldehyde, 2,5-dimethoxytetrahydrofuran or glutaraldehyde; active vinyl compounds such as divinyl sulfone, methylenebismaleimide, 5-acetyl-1,3-diacryloylhexahydro-s-triazine, 1,3,5-triacryloyl-hexahydro-s-triazine, 1,3,5-trivinylsulfonyl-hexahydro-s-triazine, bis(vinylsulfonylmethyl)ether, 1,3-bis(vinylsulfonyl)-2-propanol or 1,3-bis(vinylsulfonylacetylamide)-propane; active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethylamino)-s-triazine or N,N'-bis(2-chloroethylcarbamoyl)piperazine; epoxy compounds such as bis(2,3-epoxypropyl)-methylpropyl ammonium p-toluenesulfonate, 1,4-bis(2',3'-epoxypropyloxy)butane, 1,3,5-triglycidylisocyanurate or 1,3-diglycidyl-5-($\gamma$-acetoxy-$\beta$-oxypropyl)isocyanurate; ethyleneimine compounds such as 2,4,6-triethyleneimino-s-triazine, 1,6-hexamethylene-N,N'-bisethyleneurea or bis-$\beta$-ethyleneiminoethyl thioether; methanesulfonic acid ester compounds such as 1,2-di(methanesulfoneoxy)ethane, 1,4-di(methanesulfoneoxy)butane or 1,5-di(methanesulfoneoxy)pentane; carbodiimide compounds such as dicyclohexylcarbodiimide, 1-cyclohexyl-3-(3-trimethylaminopropyl)carbodiimide p-toluenesulfonate or 1-ethyl-3-(3-dimethylaminopropyl)carbodiimide hydrochloride; isoxazole compounds such as 2,5-dimethylisoxazole perchlorate, 2-ethyl-5-phenylisoxazole-3'-sulfonate or 5,5'-(p-phenylene)bisisoxazole; and inorganic compounds such as chromium alum or chromium acetate.

The top layer and other photographic layers may contain one or more surface active agents. Although the surface active agents are generally used as coating aids, they are sometimes used for other objects such as emulsification, sensitization, improvement of other photographic properties, or control of electrostatic charges.

These surface active agents can be classified into natural surface active agents such as saponin, nonionic surface active agents such as alkylene oxide type, glycerin type or glycidol type surface active agents, cationic surface active agents such as higher alkylamines, quaternary ammonium salts, pyridine and other heterocyclic compounds, phosphonium or sulfonium compounds, etc., anionic surface active agents having acid groups such as carboxylic acid, sulfonic acid, phosphoric acid, sulfuric acid ester or phosphoric acid ester groups, etc., and ampholytic surface active agents such as amino acids, amino sulfonic acids or sulfuric or phosphoric acid esters of aminoalcohols, etc.

Further, in the present invention, the top layer may contain a slipping agent such as the silicones described in U.S. Pat. Nos. 3,079,837, 3,080,317, 3,545,970, and 3,294,537 or modified silicones represented by the following general formula:

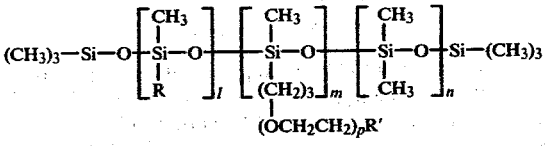

wherein l represents an integer of 0 to 100, m represents an integer of 0 to 100, l+m+n is an integer of 15 to 1,000 and p represents an integer of 1 to 1,000, R represents an alkyl group having 1 to 18 carbon atoms or an aralkyl group (for example, a benzyl group or an alkyl substituted aralkyl group) and R' represents a hydrogen atom or an alkyl group having 1 to 18 carbon atoms.

The top layer or other photographic layers in the photographic light-sensitive materials of the present invention may contain whitening agents such as stilbene, triazine, oxazole or coumarin type compounds, ultraviolet light absorbing agents such as benzotriazole or thiazoline type compounds, and other physical property improving agents.

The top layer of the photographic light-sensitive materials of the present invention may contain a matting agent in an amoant so as not to substantially damage the transparency and granularity of the images. Examples of suitable matting agents include inorganic matting agents having an average particle size of about 0.5 to 10μ, such as silicon dioxide or sodium carbonate or organic matting agents such as polymethyl methacrylate.

Further, the top layer and other photographic layers of the photographic light-sensitive materials of the present invention may contain a polymer latex as described in U.S. Pat. Nos. 3,411,911, 3,411,912 and 3,525,620.

The silver halide emulsions used in the photographic light-sensitive materials of the present invention are generally produced by mixing a solution of a water-soluble silver salt (for example, silver nitrate) with a solution of a water-soluble halogen salt (for example, potassium bromide) in the presence of a solution of a water-soluble high molecular weight material such as gelatin.

Suitable silver halides which can be used include silver chloride, silver bromide, silver bromochloride, silver iodobromide and silver iodobromochloride, and the any crystal form of the silver halide grains or distribution of grain size can be used.

Gold compounds or rhodium or iridium compounds can be used as sensitizing agents in the silver halide emulsions.

In addition, suitable chemical sensitizing agents, antifogging agents, stabilizing agents, hardening agents, spectral sensitizing agents, dyes and color couplers which can be used in the silver halide emulsion layers or other photographic layers and suitable methods of developing the photographic light-sensitive materials are described in *Product Licensing Index*, Vol. 92, 107–110 (December 1971).

The present invention is illustrated in greater detail by reference to the following examples. However, the present invention is not to be construed as being limited to these examples. Unless otherwise indicated herein, all parts, percents, ratios and the like are by weight.

EXAMPLE 1

To one side of a polyethylene terephthalate film (thickness: 100μ) having subbing layers thereon, a silver halide emulsion layer having the following Composition (1) was coated in a dry thickness of 6.0μ and a silver content of 5.0 g/m². Further, on the resulting silver halide emulsion layer, a protective layer having the following Composition (2) was coated. On the reverse side of the polyethylene terephthalate film, a gelatin back layer having the following Composition (3) was coated in a dry thickness of 5μ to produce Samples (1) to (4).

Composition (1)—Composition of the silver halide emulsion layer

Gelatin: 5 g/m²

Silver Iodobromochloride: (Cl: 80% by mol, Br: 19.5% by mol and I: 0.5% by mol)

Chloroauric Acid: 0.1 mg/m²

Sensitizing Dye: 3-Allyl-5-[2-(1-ethyl)-4-methyl-2-tetrazolin-5-ylidene-ethylidene]rhodanine—6 mg/m²

Anti-Fogging Agent: 4-Hydroxy-6-methyl-1,3,3a,7-tetrazaindene—30 mg/m²

Polyoxyethylene Compound:

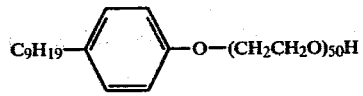

12 mg/m²

Surface Active Agent: Sodium p-dodecylbenzenesulfonate—40 mg/m²

Gelatin Hardening Agent: 2-Hydroxy-4,6-dichloro-s-triazine sodium salt—60 mg/m²

Composition (2)—Composition of the protective layer

Gelatin: 1 g/m²

Matting Agent: Silica particles having an average particle size of 4μ—0.05 g/m²

Surface Active Agent: Sodium p-dodecylbenzenesulfonate—0.03 g/m²

Gelatin Hardening Agent: 2-Hydroxy-4,6-dichloro-s-triazine sodium salt—0.01 g/m²

Composition (3)—Composition of the back layer

Gelatin: 5 g/m²

Matting Agent: Polymethyl methacrylate having an average particle size of 3.0–4.0μ

Sample (1) Control: 0.8 g/100 g of gelatin

Samples (2)-(4): 0.2 g/100 g of gelatin

Polymer Latex: Polyethyl acrylate latex having an average molecular weight of 300,000 and an average particle size of 50 mμ—50 g/100 g of gelatin Colloidal Silica:

Sample (1) Control: Absent

Sample (2): Snowtex-20—50 g/100 g of gelatin

Sample (3): Snowtex-C—50 g/100 g of gelatin

Sample (4): Colloidal silica having a $SiO_2/K_2O \simeq 935$ which was prepared by adding potassium hydroxide to a solution of colloidal silica having a $SiO_2/Na_2O \simeq 500$—50 g/100 g of gelatin, calculated as weight of dry solids.

Surface Active Agent: Sodium p-dodecylbenzenesulfonate—40 mg/m²

Gelatin Hardening Agent: 2-Hydroxy-4,6-dichloro-s-triazine sodium salt—60 mg/m²

Dye: 1:1:1 by weight mixture of Dyes (I), (II) and (III)—0.3 g/m²

Dye (I)

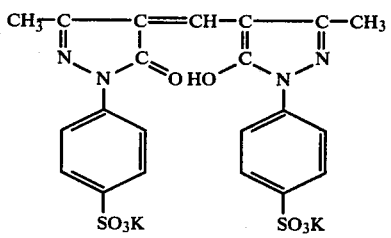

Dye (II)

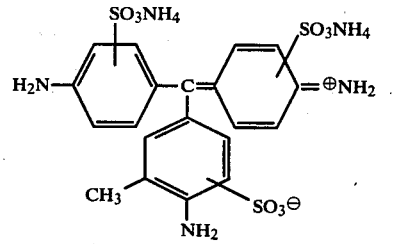

Dye (III)

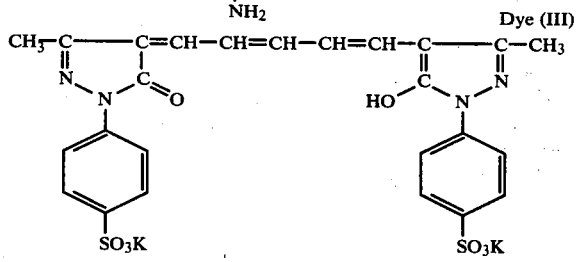

Samples (1)-(4) were evaluated in the following manner.

Adhesion Evaluation:

Each sample was cut into a size of 4 cm×4 cm to make a set of two sheets. After conditioning at 35° C. and 75% RH (relative humidity) for 24 hours, the back layer of one sample was brought into contact with the protective layer of the other sample in the same set. The set was stored at 35° C. and 75% RH for 24 hours under a load of 1 kg. After the weight was removed, the back layer was stripped off from the protective layer and the area of adhesion (the part on the protective layer which was colored by the dye transferred from the back layer) was measured.

The antiadhesive property was evaluated using the following scale.

| | Ratio of Area of Adhesion (%) |
|---|---|
| A | 0–25 |
| B | 26–50 |
| C | 51–75 |
| D | above 76% or impossible to strip apart |

The antiadhesive property test results are shown in Table 1 below.

TABLE 1

| | Sample (1) (Control) | Sample (2) (Comparison) | Sample (3) (Comparison) | Sample (4) (present invention) |
|---|---|---|---|---|
| Anti-adhesive Property | D | B–C | B–C | A |

It can be understood from the results in Table 1 above that, in the back layer containing colloidal silica having a $SiO_2/K_2O \simeq 935$ and a $SiO_2/Na_2O \simeq 500$, the antiadhesive property was markedly improved.

EXAMPLE 2

Samples (11) to (15) having the same composition as described in Example 1 except that the back layer had the following Composition (4) were produced.

Composition (4)—Composition of the back layer

The gelatin, the polymer latex, the surface active agent, the gelatin hardening agent and the dye were the same as those in Composition (3) of Example 1.

Matting Agent: Polymethyl methacrylate having an average particle size of 3.0–4.0μ

Sample (11) Control: 0.8 g/100 g of gelatin

Samples (12)-(15): 0.2 g/100 g of gelatin

Colloidal Silica:

Sample (11) Control: Absent

Sample (12): Ludox AM—40 g/100 g of gelatin

Sample (13): Ludox HS-30—40 g/100 g of gelatin

Sample (14): Nalcoag 1030—40 g/100 g of gelatin

Sample (15): Colloidal silica having an $SiO_2/K_2O \simeq 130$ which was prepared by adding potassium hydroxide to a solution of colloidal silica having an $SiO_2/Na_2O \simeq 770$ —40 g/100 g of gelatin The results of the adhesion testing evaluated in the same manner as described in Example 1 are shown in Table 2 below.

TABLE 2

| | Sample (11) (Control) | Sample (12) (Comparison) | Sample (13) (Comparison) | Sample (14) (Comparison) | Sample (15) (present invention) |
|---|---|---|---|---|---|
| Anti-adhesive Property | D | B–C | B–C | B–C | A |

It can be seen from the results in Table 2 above that, in the back layer containing colloidal silica having an $SiO_2/K_2O \simeq 130$ and an $SiO_2/Na_2O \simeq 770$, the antiadhesive property was markedly improved.

EXAMPLE 3

To one side of a polyethylene laminated paper sheet, a blue-sensitive silver halide emulsion layer, an intermediate layer, a green-sensitive silver halide emulsion layer, an ultraviolet light absorbing layer, a red-sensitive silver halide emulsion layer and a protective layer were coated in this order on the sheet to produce Samples (21) to (25) having the following Composition (5).

Composition (5)

Composition 5-1—Composition of the protective layer
Gelatin: 1.5 g/m$^2$
Surface Active Agent: 2-Sulfonato succinic acid bis(2-ethylhexyl)ester sodium salt—1.4 g/100 g of gelatin
Gelatin Hardening Agent: 2-Hydroxy-4,6-dichloro-s-triazine sodium salt—1.5 g/100 g of gelatin
Colloidal Silica:
Sample (21) Control: Absent
Sample (22): Colloidal silica having an $SiO_2/K_2O \simeq 160$ and an $SiO_2/Na_2O \simeq 750$—15 g/100 g of gelatin
Sample (23): Colloidal silica having an $SiO_2/K_2O \simeq 160$ and an $SiO_2/Na_2O \simeq 750$—30 g/100 g of gelatin
Sample (24): Colloidal silica having an $SiO_2/K_2O \simeq 160$ and an $SiO_2/Na_2O \simeq 750$—45 g/100 g of gelatin
Sample (25): Colloidal silica having an $SiO_2/K_2O \simeq 160$ and an $SiO_2/Na_2O \simeq 750$—60 g/100 g of gelatin Composition 5-2—Composition of the red-sensitive silver halide emulsion layer
Gelatin: 1.5 g/m$^2$+Cellulose sulfate having an average molecular weight of 100,000—0.15 g/m$^2$
Silver Halide: AgBr 50% by mol+AgCl:50% by mol—0.5 g/m$^2$
Coupler: 2-[α-(2,4-Di-t-amylphenoxy)butyramido]-4,6-dichloro-5-methylphenol—100 g/100 g of silver halide
Sensitizing Dye: Anhydro-3,3'-di-(δ-sulfobutyl)-5,5',6,6'-tetramethyl-thiacarbocyanine hydroxide—0.3 g/100 g of silver halide
Anti-Fogging Agent: 4-Hydroxy-6-methyl-1,3,3a,7-tetrazaindene—0.9 g/100 g of silver halide
Gelatin Hardening Agent: bis(Vinylsulfonylethyl)ether—3.5 g/100 g of gelatin
Surface Active Agent: Sodium dodecylbenzene sulfonate—1 g/100 g of gelatin Composition 5-3—Composition of the ultraviolet light absorbing layer
Gelatin: 1 g/m$^2$+Cellulose sulfate having an average molecular weight of 100,000—0.1 g/m$^2$
Ultraviolet Light Absorbing Agent: Tinuvin (trade name, produced by Ciba-Geigy)—1 g/m$^2$
Gelatin Hardening Agent: 2-Hydroxy-4,6-dichloro-s-triazine sodium salt—1.5 g/100 g of gelatin
Surface Active Agent: Sodium dodecylbenzenesulfonate—1 g/100 g of gelatin Composition 5-4—Composition of the green-sensitive silver halide emulsion layer
Gelatin: 1.5 g/m$^2$+Cellulose sulfate having an average molecular weight of 100,000—0.15 g/m$^2$
Silver Halide: AgBr: 50% by mol+AgCl: 50% by mol—0.7 g/m$^2$
Coupler: 1-(2,4,6-Trichlorophenyl)-3-(2-chloro-5-tetradecanamido)anilino-2-pyrazolin-5-one—57 g/100 g of silver halide
Sensitizing Dye: Anhydro-3,3'-di-(γ-sulfopropyl)-5,5'-diphenyl-9-ethylcarbocyanine hydroxide sodium salt—0.3 g/100 g of silver halide
Anti-Fogging Agent: 4-Hydroxy-6-methyl-1,3,3a,7-tetrazaindene—0.6 g/100 g of silver halide
Gelatin Hardening Agent: bis(Vinylsulfonylethyl)ether—3 g/100 g of gelatin
Surface Active Agent: Sodium dodecylbenzenesulfonate—0.8 g/100 g of gelatin Composition 5-5—Composition of the intermediate layer
Gelatin: 1.5 g/m$^2$+Cellulose sulfate having an average molecular weight of 100,000—0.15 g/m$^2$
Gelatin Hardening Agent: 2-Hydroxy-4,6-dichloro-s-triazine sodium salt—1.5 g/100 g of gelatin
Surface Active Agent: Sodium dodecylbenzenesulfonate—0.6 g/100 g of gelatin Composition 5-6—Composition of the blue-sensitive silver halide emulsion layer
Gelatin: 1.5 g/m$^2$+Cellulose sulfate having an average molecular weight of 100,000—0.15 g/m$^2$
Silver Halide: AgBr: 80% by mol+AgCl: 20% by mol—0.7 g/m$^2$
Coupler: α-Pivaloyl-α-(2,4-dioxo-5,5'-dimethyloxazolidin-3-yl)-2-chloro-5-[α-(2,4-di-t-amylphenoxy)-butyramido]-acetanilide—0.7 g/100 g of silver halide
Anti-Fogging Agent: 4-Hydroxy-6-methyl-1,3,3a,7-tetrazaindene—0.4 g/100 g of silver halide
Gelatin Hardening Agent: bis(Vinylsulfonylethyl)ether—2.8 g/100 g of gelatin
Surface Active Agent: Sodium dodecylbenzenesulfonate—0.3 g/100 g of gelatin After Samples (21) to (25) had been subjected to the following development processing for a color paper, adhesion testing was carried out.

| Processing | Temperature (°C.) | Time |
|---|---|---|
| Color Development | 31 | 3 min 30 sec |
| Stop-Fixing | " | 30 sec |
| Bleach-Fixing | " | 1 min 30 sec |
| Water Wash | " | 1 min |
| Stabilizing | " | 1 min |
| Rinsing | " | 2 sec |

The processing solutions used in the above processing had the following compositions.

| | |
|---|---|
| Composition of Color Developing Solution: | |
| Benzyl Alcohol | 15 ml |
| Sodium Sulfite | 5 g |
| Potassium Bromide | 0.5 g |
| Hydroxylamine Sulfate | 2 g |
| Sodium Carbonate | 30 g |
| Sodium Nitrilotriacetate | 2 g |
| 4-Amino-3-methyl-N-ethyl-N-β-methanesulfonamido)ethylaniline | 5 g |
| Water to make | 1,000 ml |
| Composition of Stop-Fixing Solution: | |
| Sodium Thiosulfate | 30 g |
| Sodium Sulfite | 2 g |
| Sodium Acetate | 25 g |
| Tartaric Acid | 4.3 g |
| Sodium Carbonate (monohydrate) | 1.9 g |
| Water to make | 1,000 ml |
| Composition of Bleach-Fixing Solution: | |
| Ammonium Thiosulfate (70% aq, soln.) | 150 ml |
| Iron Ethylenediaminetetraacetate | 36.6 g |
| Disodium ethylenediaminetetraacetate | 3.4 g |
| Sodium Sulfite | 2 g |
| Sodium Carbonate (monohydrate) | 5.5 g |
| Water to make | 1,000 ml |

-continued

| Composition of Stabilizing Solution: | |
|---|---|
| Sodium Benzoate | 0.5 g |
| Citric Acid (monohydrate) | 6.7 g |
| Diethanolamine | 2.2 g |
| Water to make | 1,000 ml |

Adhesion Evaluation:

After the samples subjected to the above-described development processing were dried, they were cut into a size of 4 cm×8 cm to make a set of two sheets each. After conditioning at 35° C. and 90% RH for 24 hours, the protective layer of one sample was brought into contact with the protective layer of the other sample in each set. The set was stored at 35° C. and 90% RH for 24 hours under a load of 1 kg. After the weight was removed, the protective layers were stripped from each other and the area of the part adhered (the luster was different) was measured. Evaluation of the antiadhesive property was made on the basis of the following grades.

| | Area of Adhesion (%) |
|---|---|
| A | 0–40 |
| B | 41–80 |
| C | above 81% or a part of the emulsion layer or the support was stripped off, because the adhesive strength was high |

The results of tests for antiadhesive property are set forth in Table 3 below.

TABLE 3

| | Sample (21) (Control) | Sample (22) (Present invention) | Sample (23) (Present invention) | Sample (24) (Present invention) | Sample (25) (Present invention) |
|---|---|---|---|---|---|
| Anti-adhesive Property | C | B | A | A | A |

It can be seen from the results in Table 3 above that the antiadhesive property in the present invention was improved.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide emulsion layer and an outermost layer thereof containing gelatin and colloidal silica prepared by adding potassium hydroxide to an aqueous dispersion of colloidal silica, said aqueous dispersion being a dispersion of microparticles of silicic anhydride having an average particle size of about 7 to 120 mμ and said colloidal silica present in said aqueous dispersion having an $SiO_2/Na_2O$ ratio of about 350 to about 1,200 and wherein the amount of said potassium hydroxide added is such that the colloidal silica has an $SiO_2/K_2O$ ratio of about 50 to about 1,500.

2. The light-sensitive material of claim 1, wherein said outermost layer of said photographic light-sensitive material is a protective layer for said at least one silver halide photographic emulsion layer or a back layer on the opposite surface of said support than that on which said at least one silver halide emulsion layer is coated.

3. The light-sensitive material of claim 1, wherein the ratio by weight of said colloidal silica to gelatin in said outermost layer ranges from about 0.05:1 to about 1.0:1 based on the dry weight of the gelatin of said outermost layer.

4. The light-sensitive material of claim 1, wherein the gelatin in said outermost layer containing gelatin is present in an amount of at least about 50% by weight of the total amount of binder present in said outermost layer.

5. The light-sensitive material of claim 1, wherein said gelatin is acid-processed gelatin, lime-processed gelatin or enzyme-processed gelatin.

* * * * *